US007889844B2

(12) United States Patent
Okunuki et al.

(10) Patent No.: US 7,889,844 B2
(45) Date of Patent: Feb. 15, 2011

(54) MULTI X-RAY GENERATOR AND MULTI X-RAY IMAGING APPARATUS

(75) Inventors: Masahiko Okunuki, Akiruno (JP); Osamu Tsujii, Utsunomiya (JP); Takeo Tsukamoto, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/875,745

(22) Filed: Sep. 3, 2010

(65) Prior Publication Data

US 2010/0329429 A1 Dec. 30, 2010

Related U.S. Application Data

(63) Continuation of application No. 12/281,453, filed as application No. PCT/JP2007/054090 on Mar. 2, 2007.

(30) Foreign Application Priority Data

Mar. 3, 2006 (JP) ..... 2006-057846
Mar. 1, 2007 (JP) ..... 2007-050942

(51) Int. Cl.
*H01J 35/00* (2006.01)

(52) U.S. Cl. ..... 378/122; 378/140

(58) Field of Classification Search ..... 378/119, 378/122, 143, 140, 136
See application file for complete search history.

(56) References Cited

U.S. PATENT DOCUMENTS 6,259,765 B1 * 7/2001 Baptist ..... 378/136
6,333,968 B1 * 12/2001 Whitlock et al. ..... 378/136
7,050,537 B2 5/2006 Tsujii ..... 378/95
7,104,686 B2 9/2006 Watanabe et al. ..... 378/189
7,315,606 B2 1/2008 Tsujii ..... 378/20
7,386,157 B2 6/2008 Tago et al. ..... 382/130
2004/0120463 A1 6/2004 Wilson et al. ..... 378/144
2004/0213378 A1 * 10/2004 Zhou et al. ..... 378/122
2005/0226486 A1 10/2005 Tsujii ..... 382/132

(Continued)

FOREIGN PATENT DOCUMENTS

DE 2203 403 A1 8/1973

(Continued)

OTHER PUBLICATIONS

J. Zhang et al., "Stationary Scanning X-Ray Source Based on Carbon Nanotube Field Emitters", *Applied Physics Letters*, vol. 86, pp. 184104-1 to 184104-3 (Apr. 25, 2005).

*Primary Examiner*—Hoon Song
(74) *Attorney, Agent, or Firm*—Fitzpatrick, Cella, Harper & Scinto

(57) ABSTRACT

A compact apparatus can form multi X-ray beams with good controllability. Electron beams (e) emitted from electron emission elements (15) of a multi electron beam generating unit (12) receive the lens effect of a lens electrode (19). The resultant electron beams are accelerated to the final potential level by portions of a transmission-type target portion (13) of an anode electrode (20). The multi X-ray beams (x) generated by the transmission-type target portion (13) pass through an X-ray shielding plate (23) and X-ray extraction portions (24) in a vacuum chamber and are extracted from the X-ray extraction windows (27) of a wall portion (25) into the atmosphere.

13 Claims, 15 Drawing Sheets

U.S. PATENT DOCUMENTS

2009/0185660 A1* 7/2009 Zou et al. ..... 378/122

FOREIGN PATENT DOCUMENTS

| | | |
|---|---|---|
| GB | 268012 | 3/1927 |
| JP | 08-264139 | 10/1996 |
| JP | 09-180894 | 7/1997 |
| JP | 2002-214353 | 7/2002 |
| JP | 2004-111336 | 4/2004 |
| JP | 2004-329784 | 11/2004 |
| JP | 2004-333131 | 11/2004 |
| JP | 2004-357724 | 12/2004 |
| WO | 2006-009053 | 1/2006 |

* cited by examiner

MULTI X-RAY GENERATOR AND MULTI X-RAY IMAGING APPARATUS

RELATED APPLICATIONS

The present application is a continuation of application Ser. No. 12/281,453, filed Sep. 2, 2008, which is a National Stage filing under 35 U.S.C. §371 of International Application No. PCT/JP2007/054090, filed Mar. 2, 2007. the present application claims benefit of parent application Ser. No. 12/281,453 under 35 U.S.C. §120, and claims priority benefit under 35 U.S.C. §119 of Japanese Patent Applications 2006-057846, filed Mar. 3, 2006, and 2007-050942, filed Mar. 1, 2007; the entire contents of each of the mentioned prior applications are incorporated herein by reference.

TECHNICAL FIELD

The present invention relates to a multi X-ray generator used for nondestructive X-ray imaging, diagnosis, and the like in the fields of medical equipment and industrial equipment which use X-ray sources.

BACKGROUND ART

Conventionally, an X-ray tube uses a thermal electron source as an electron source, and obtains a high-energy electron beam by accelerating the thermal electrons emitted from a filament heated to a high temperature via a Wehnelt electrode, extraction electrode, acceleration electrode, and lens electrode. After shaping the electron beam into a desired shape, the X-ray tube generates X-rays by irradiating an X-ray target portion made of a metal with the beam.

Recently, a cold cathode electron source has been developed as an electron source replacing this thermal electron source, and has been widely studied as an application of a flat panel display (FPD). As a typical cold cathode, a Spindt type electron source is known, which extracts electrons by applying a high electric field to the tip of a needle with a size of several 10 nm. There are also available an electron emitter using a carbon nanotube (CNT) as a material and a surface conduction type electron source which emits electrons by forming a nanometer-order microstructure on the surface of a glass substrate.

Patent references 1 and 2 propose, as an application of these electron sources, a technique of extracting X-rays by forming a single electron beam using a Spindt type electron source or a carbon nanotube type electron source. Patent reference 3 and non-patent reference 1 disclose a technique of generating X-rays by irradiating an X-ray target portion with electron beams from a multi electron source using a plurality of these cold cathode electron sources.

Patent reference 1: Japanese Patent Laid-Open No. 9-180894

Patent reference 2: Japanese Patent Laid-Open No. 2004-329784

Patent reference 3: Japanese Patent Laid-Open No. 8-264139

Non-patent reference 1: *Applied Physics Letters* 86, 184104 (2005), J. Zhang, "Stationary Scanning X-Ray Source Based on Carbon Nanotube Field Emitters".

DISCLOSURE OF INVENTION

Problems that the Invention is to Solve

FIG. 14 is a view showing the arrangement of a conventional X-ray generating scheme using multi electron beams.

In a vacuum chamber 1 in which a plurality of electron sources comprising multi electron emission elements generate electron beams e, the electron beams e are impinged upon a target portion 2 to generate X-rays. The generated X-rays are directly extracted into the atmosphere. However, the X-rays generated from the target portion 2 diverge in all directions in vacuum. For this reason, it is difficult to form independent X-ray beams x by using the X-rays output from X-ray extraction windows 4 of an X-ray shielding plate 3 provided on the atmosphere side because X-rays emitted from adjacent X-ray sources are transmitted through the same X-ray extraction windows 4.

In addition, as shown in FIG. 15, when X-rays are extracted from the X-ray extraction window 4 to the atmosphere side by providing one X-ray shielding plate 6 on the atmosphere side of a wall portion 5 of the vacuum chamber 1, many leakage X-rays x2, of diverging X-rays x1, which are not impinged upon an object P are output. Furthermore, it is difficult to form multi X-ray beams with uniform intensity because of the use of a plurality of electron sources comprising multi electron emission elements unlike a conventional single X-ray source.

It is an object of the present invention to provide a compact multi X-ray generator which can solve the above problems and form multi X-ray beams with few scattered X-rays and excellent uniformity and an X-ray imaging apparatus using the generator.

Means of Solving the Problems

In order to achieve the above object, a multi X-ray generator according to the present invention is technically characterized by comprising a plurality of electron emission elements, acceleration means for accelerating electron beams emitted from the plurality of electron emission elements, and a target portion which is irradiated with the electron beams, wherein the target portion is provided in correspondence with the electron beams, the target portion comprises X-ray shielding means, and X-rays generated from the target portion are extracted as multi X-ray beams into the atmosphere.

EFFECTS OF THE INVENTION

According to a multi X-ray generator according to the present invention, X-ray sources using a plurality of electron emission elements can form multi X-ray beams whose divergence angles are controlled, with few scattered and leakage X-rays. Using the multi X-ray beams can realize a compact X-ray imaging apparatus with excellent uniformity of beams. Other features and advantages of the present invention will be apparent from the following description taken in conjunction with the accompanying drawings.

BRIEF DESCRIPTION OF DRAWINGS

The accompanying drawings, which are incorporated in and constitute a part of the specification, illustrate embodiments of the invention and, together with the description, serve to explain the principles of the invention, and in which.

BEST MODE FOR CARRYING OUT THE INVENTION

The present invention will be described in detail based on the embodiments shown in FIGS. 1 to 13.

First Embodiment

Figure 1:
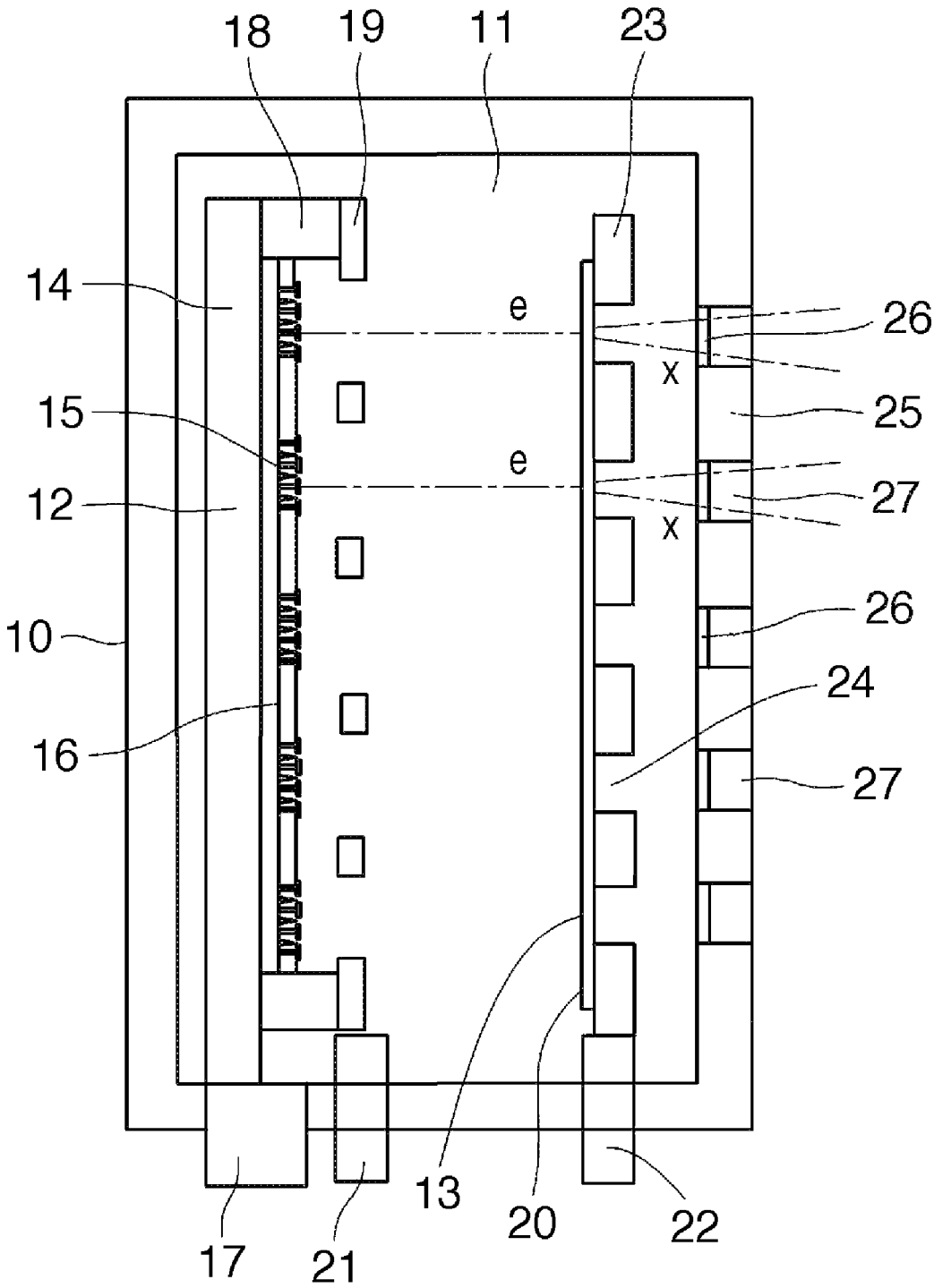
FIG. 1 is a view showing the arrangement of a multi X-ray source body according to the first embodiment.

FIG. 1 is a view showing the arrangement of a multi X-ray source body 10. An electron beam generating unit 12 and an anode electrode 20 are arranged in a vacuum chamber 11. The electron beam generating unit 12 comprises an element substrate 14 and an element array 16 having a plurality of electron emission elements 15 arrayed on the element substrate. A driving signal unit 17 controls the driving of the electron emission elements 15. A lens electrode 19 fixed to an insulating member 18 is provided to control electron beams e emitted from the electron emission elements 15. High voltages are applied to the electrodes 19 and 20 via high voltage introduction portions 21 and 22.

A transmission-type target portion 13 upon which the emitted electron beams e impinge is discretely formed on the anode electrode 20 so as to face the electron beams e. The transmission-type target portion 13 is further provided with an X-ray shielding plate 23 made of a heavy metal. The X-ray shielding plate 23 in this vacuum chamber has X-ray extraction portions 24. A wall portion 25 of the vacuum chamber 11 is provided with X-ray extraction windows 27 having X-ray transmission films 26 at positions in front of the X-ray extraction portions.

The electron beams e emitted from the electron emission elements 15 receive the lens effect of the lens electrode 19, and are accelerated to the final potential level by portions of the transmission-type target portion 13 of the anode electrode 20. X-ray beams x generated by the transmission-type target portion 13 pass through the X-ray extraction portions 24 and are extracted to the atmosphere via the X-ray extraction windows 27. The plurality of X-ray beams x are generated in accordance with the plurality of electron beams e from the plurality of electron emission elements 15. The plurality of X-ray beams x extracted from the X-ray extraction portions 24 form multi X-ray beams.

Figure 2:
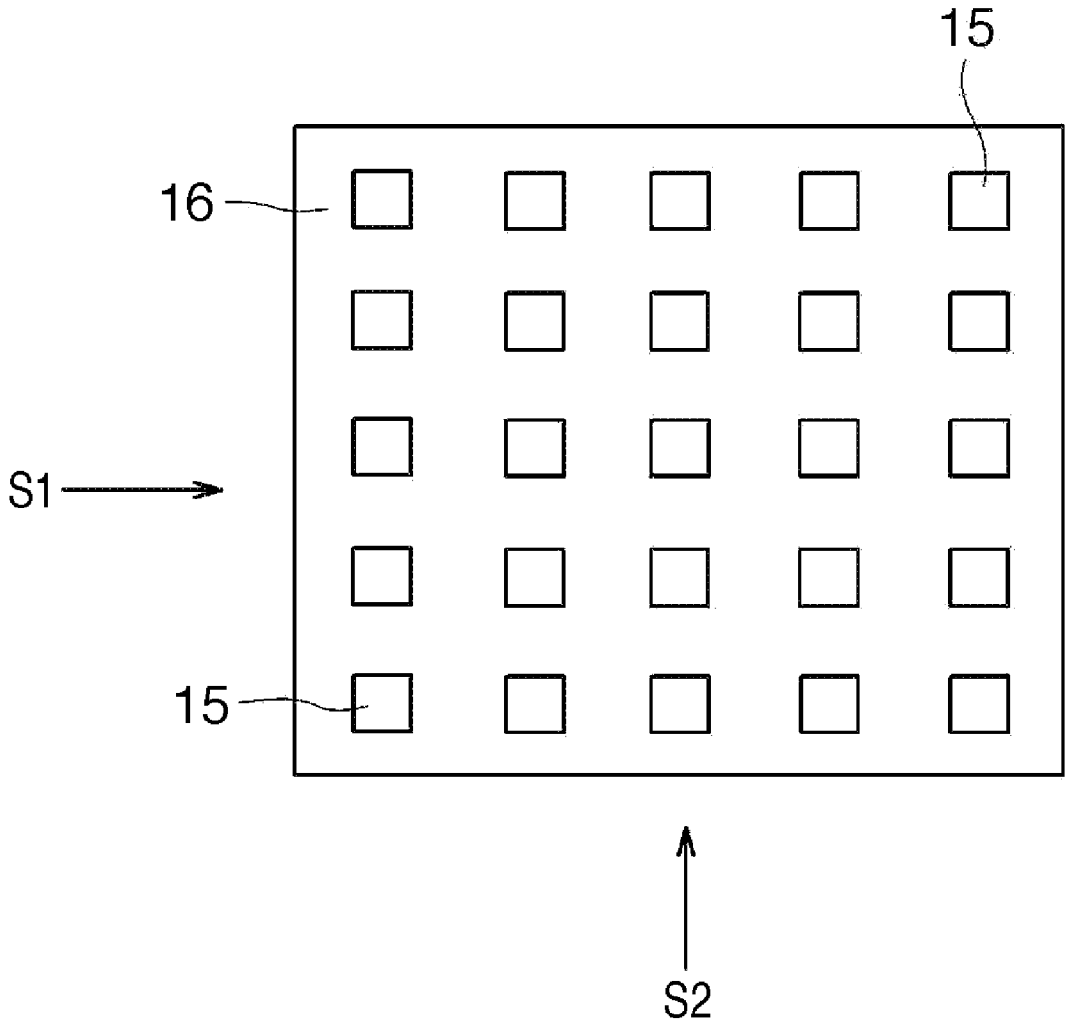
FIG. 2 is a plan view of an element substrate.

The electron emission elements 15 are two-dimensionally arrayed on the element array 16, as shown in FIG. 2. With recent advances in nanotechnology, it is possible to form a fine structure with nm size at a predetermined position by a device process. The electron emission elements 15 are manufactured by this nanotechnology. The amounts of electron emission of the electron emission elements 15 are individually controlled by driving signals S1 and S2 (to be described later) via the driving signal unit 17. That is, individually controlling the amounts of electron emission of the electron emission elements 15 on the element array 16 by using the driving signals S1 and S2 as matrix signals makes it possible to individually ON/OFF-control X-ray beams.

Figure 3:
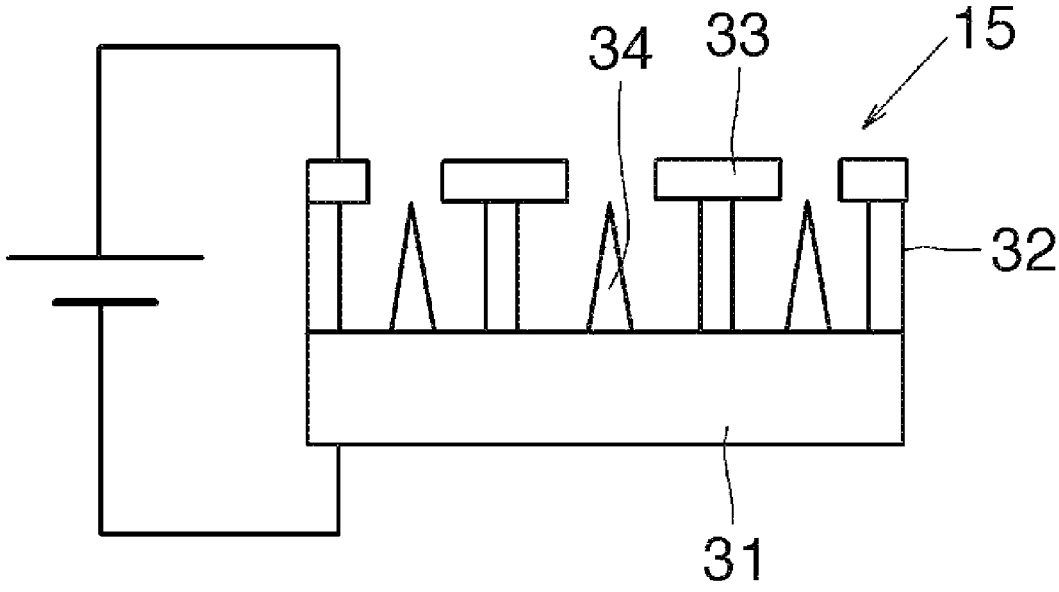
FIG. 3 is a view showing the arrangement of a Spindt type element.

FIG. 3 is a view showing the arrangement of the Spindt type electron emission element 15. Insulating members 32 and extraction electrodes 33 are provided on an element substrate 31 made of Si. Conical emitters 34 each made of a metal or a semiconductor material and having a tip diameter of several 10 nm are formed in μm-size grooves in the centers of the electrodes by using a device manufacturing process.

Figure 4:
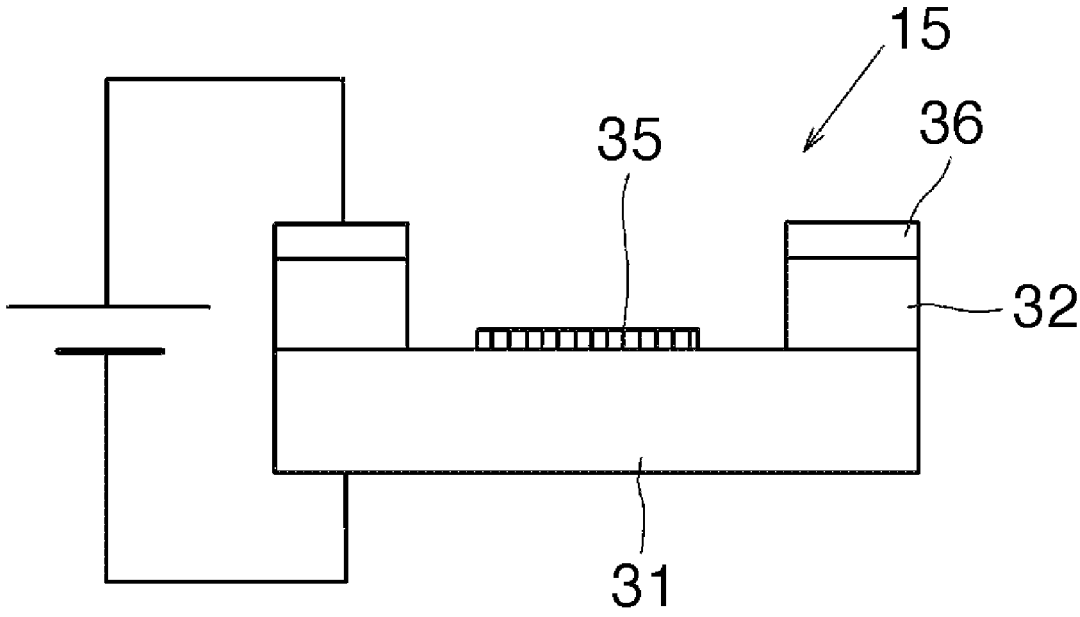
FIG. 4 is a view showing the arrangement of a carbon nanotube type element.

FIG. 4 is a view showing the arrangement of the carbon nanotube type electron emission element 15. As a material for an emitter 35, a carbon nanotube comprising a fine structure with several 10 nm is used. The emitter 35 is formed in the center of an extraction electrode 36.

When voltages of several 10 to several 100 V are applied to the extraction electrodes 33 and 36 of the Spindt type element and carbon nanotube type element, high electric fields are applied to the tips of the emitters 34 and 35, thereby emitting the electron beams e by the field emission phenomenon.

Figure 5:
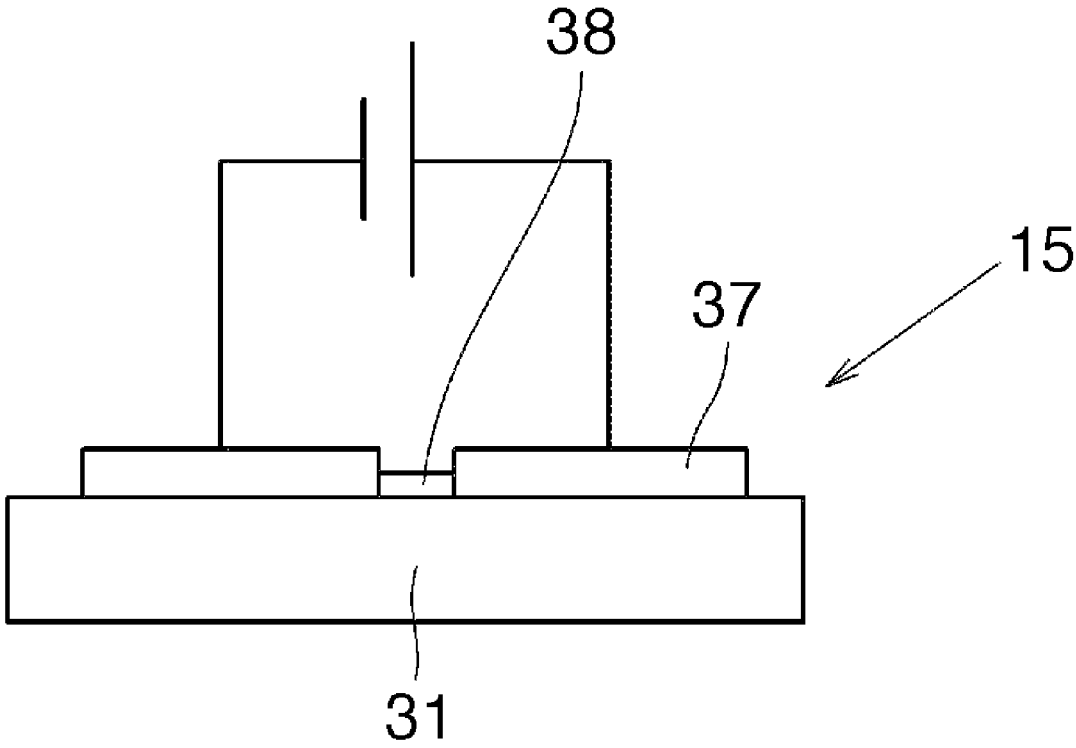
FIG. 5 is a view showing the arrangement of a surface conduction type element.

FIG. 5 is a view showing the arrangement of the surface conduction type electron emission element 15. A fine structure comprising nano particles is formed as an emitter 38 in a gap in a thin-film electrode 37 formed on a glass element substrate 31. When a voltage of 10-odd V is applied between the electrodes of this surface conduction type element, a high electric field is applied to the fine gap formed by fine particles between the electrodes. This generates conduction electrons. At the same time, the electron beams e are emitted in the vacuum, and electron emission can be controlled with a relatively low voltage.

Figure 6:
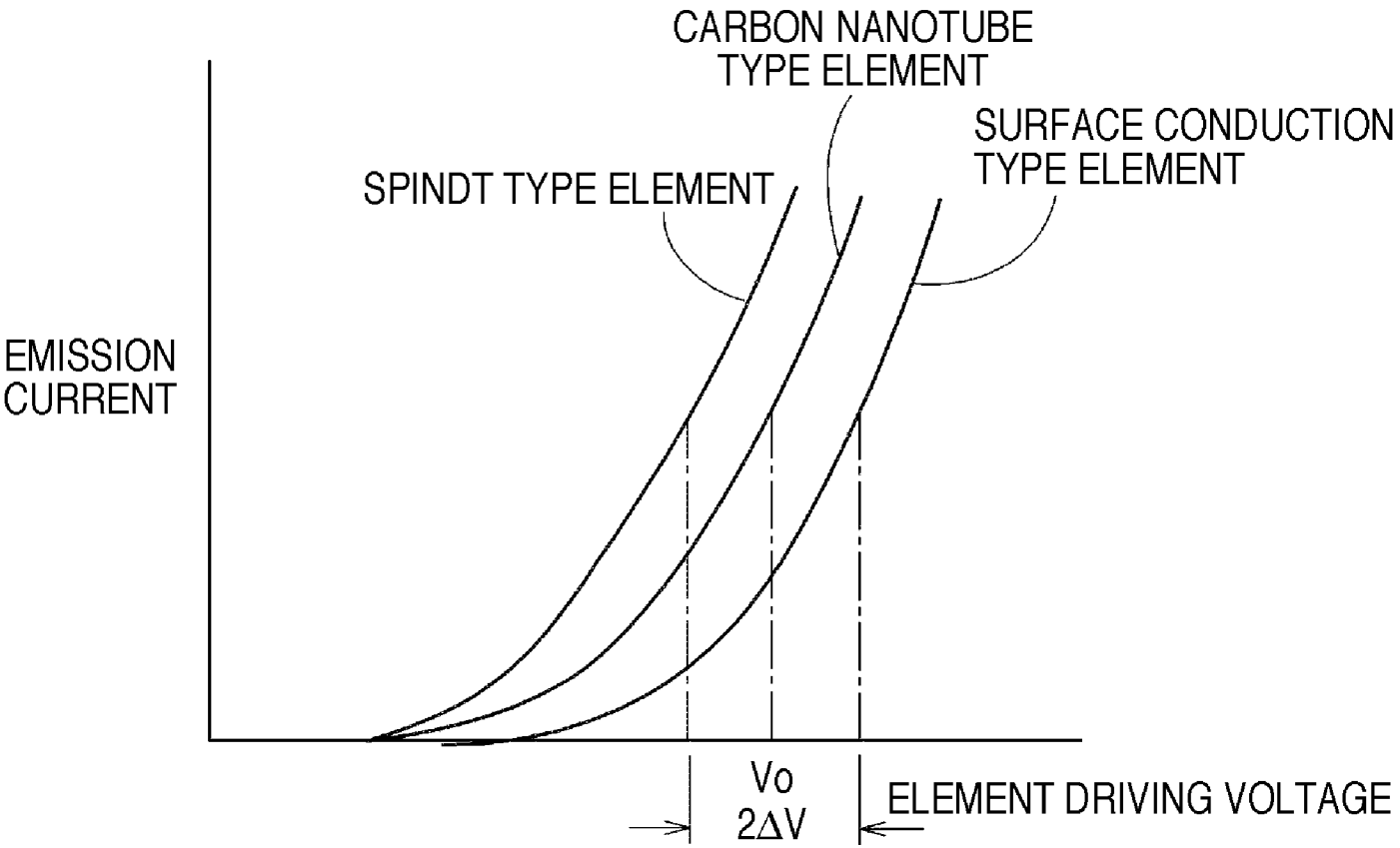
FIG. 6 is a graph showing the voltage-current characteristics of multi electron emission elements.

FIG. 6 shows the voltage-current characteristics of the Spindt type element, carbon nanotube type element, and surface conduction type element. In order to obtain a constant emission current, the voltage obtained by correcting an average driving voltage Vo with a correction voltage $\Delta V$ is applied as a driving voltage to the electron emission elements 15. This can correct variations in emission currents from the electron emission elements 15.

As electron sources for the generation of multi X-ray beams other than the above electron emission elements, MIM (Metal Insulator Metal) type elements and MIS (Metal Insulator Semiconductor) type elements can be used. In addition, cold cathode type electron sources such as a semiconductor PN junction type electron source and a Schottky junction type electron source can be used.

An X-ray generator using such a cold cathode type electron emission element as an electron source emits electrons by applying a low voltage to the electron emission element at room temperature without heating the cathode. This generator therefore requires no wait time for the generation of X-rays. In addition, since no power is required for heating the cathode, a low-power-consumption X-ray source can be manufactured even by using a multi X-ray source. Since currents from these electron emission elements can be ON/OFF-controlled by high-speed driving operation using driving voltages, a multiarray type X-ray source can be manufactured, which selects an electron emission element to be driven and performs high-speed response operation.

Figure 7:
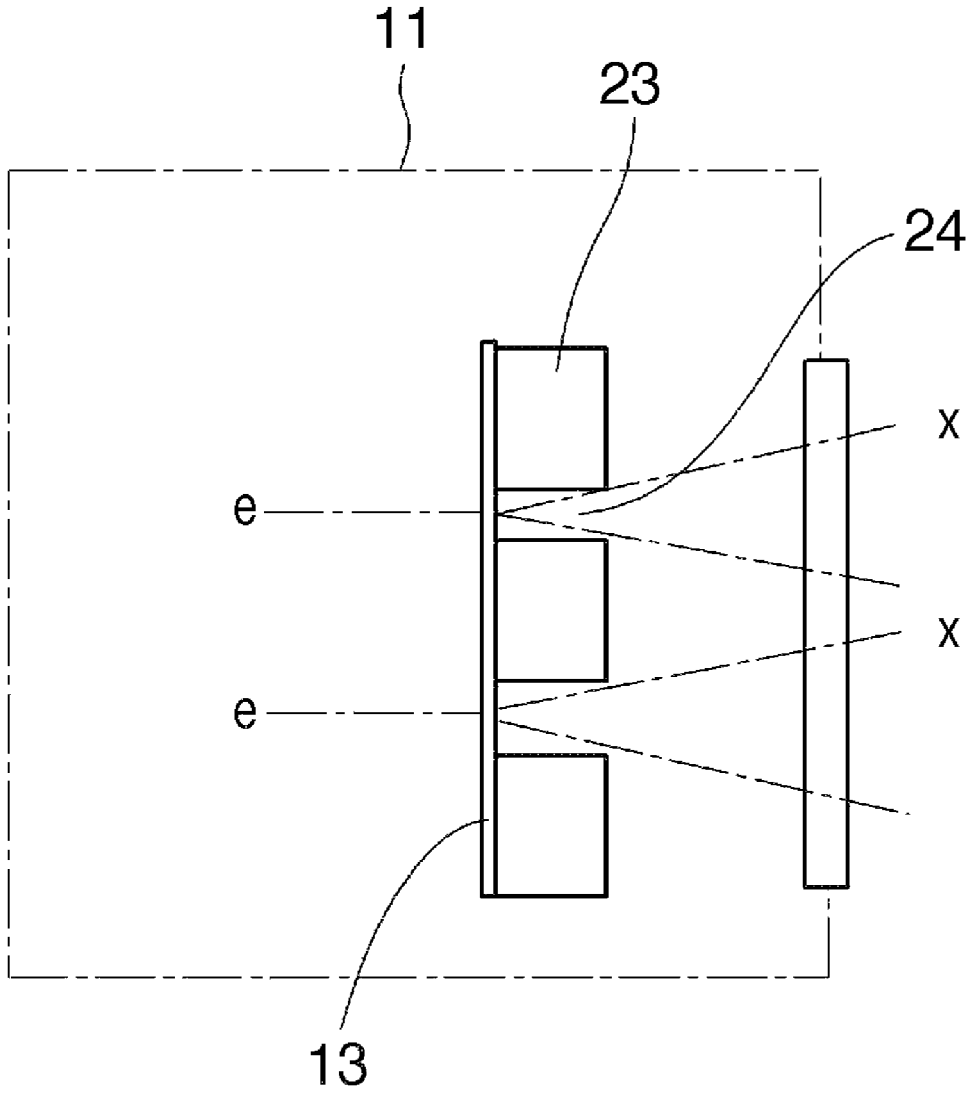
FIG. 7 is a view showing the arrangement of a multi transmission-type target portion having an X-ray shielding plate.

FIGS. 7 to 11 are views for explaining a method of forming X-ray beams x. FIG. 7 shows an example of the multi transmission-type target portion 13. The transmission-type target portions 13 corresponding to the electron emission elements 15 are arranged side by side in the vacuum chamber 11. In order to form multi X-ray beams x, it is necessary to separately extract, from the vacuum chamber 11, the X-rays generated by irradiating the transmission-type target portion 13 with one electron beam e and the X-ray beam x generated by an adjacent electron beam e without mixing them.

For this reason, the X-ray shielding plate 23 in the vacuum chamber and the multi transmission-type target portion 13 are integrated into a single structure. The X-ray extraction portions 24 provided in the X-ray shielding plate 23 are arranged at positions corresponding to the electron beams e so as to extract the X-ray beams x, each having a necessary divergence angle, from the transmission-type target portion 13.

Since the transmission-type target portion 13 formed by a thin metal film generally has low heat dissipation, it is difficult to apply large power. The transmission-type target portion 13 in this embodiment is, however, covered by the thick X-ray shielding plate 23 except for areas from which the X-ray beams x are extracted upon irradiation with the electron beams e, and the transmission-type target portion 13 and the X-ray shielding plate 23 are in mechanical and thermal contact with each other. For this reason, the X-ray shielding plate 23 has a function of dissipating heat generated by the transmission-type target portion 13 by heat conduction.

This makes it possible to form an array of a plurality of transmission-type target portions 13 to which power much larger than that applied to a conventional transmission type target portion can be applied. In addition, using the thick X-ray shielding plate 23 can improve the surface accuracy and hence manufacture a multi X-ray source with uniform X-ray emission characteristics.

Figure 8:
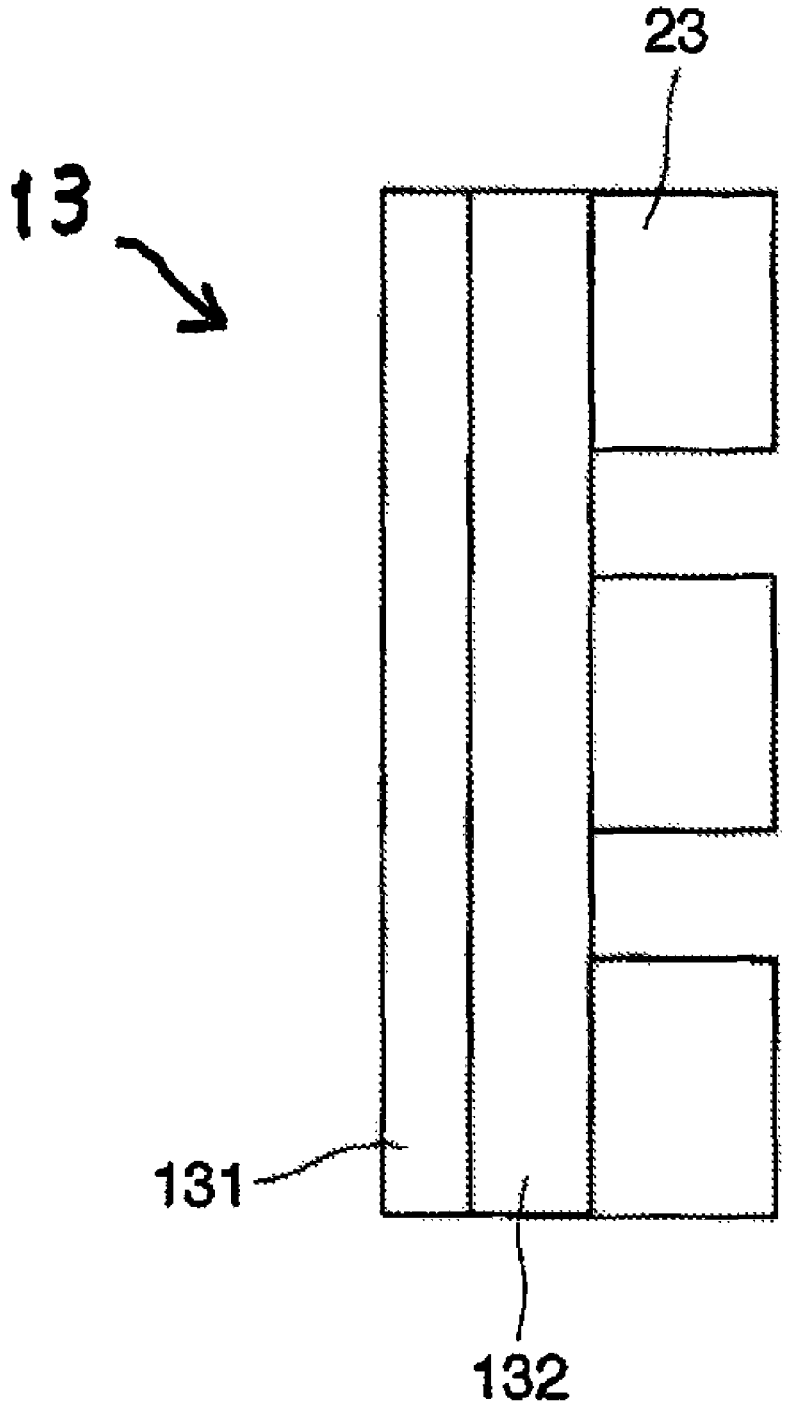
FIG. 8 is a view showing the arrangement of the transmission-type target portion.

As shown in FIG. 8, the transmission-type target portion 13 comprises an X-ray generating layer 131 and an X-ray generation support layer 132, and has excellent functionality with a high X-ray generation efficiency. The X-ray shielding plate 23 is provided on the X-ray generation support layer 132.

The X-ray generating layer 131 is made of a heavy metal with a film thickness of about several 10 nm to several μm to reduce the absorption of X-rays when the X-ray beams x are transmitted through the transmission-type target portion 13. The X-ray generation support layer 132 uses a substrate made of a light element to support the thin film layer of the X-ray generating layer 131 and also reduce intensity attenuation by the absorption of the X-ray beams x by improving the cooling efficiency of the X-ray generating layer 131 heated by the application of the electron beams e.

It has been generally thought that for the conventional X-ray generation support layer 132, metal beryllium is effective as a substrate material. In this embodiment, however, an Al, AlN, or SiC film with a thickness of about 0.1 mm to several mm or a combination thereof is used. This is because this material has high thermal conductivity and an excellent X-ray transmission characteristic, effectively absorbs X-ray beams, of the X-ray beams x, which are in a low-energy region and have little contribution to the quality of an X-ray transmission image by 50% or lower, and has a filter function of changing the radiation quality of the X-ray beams x.

Figure 9:
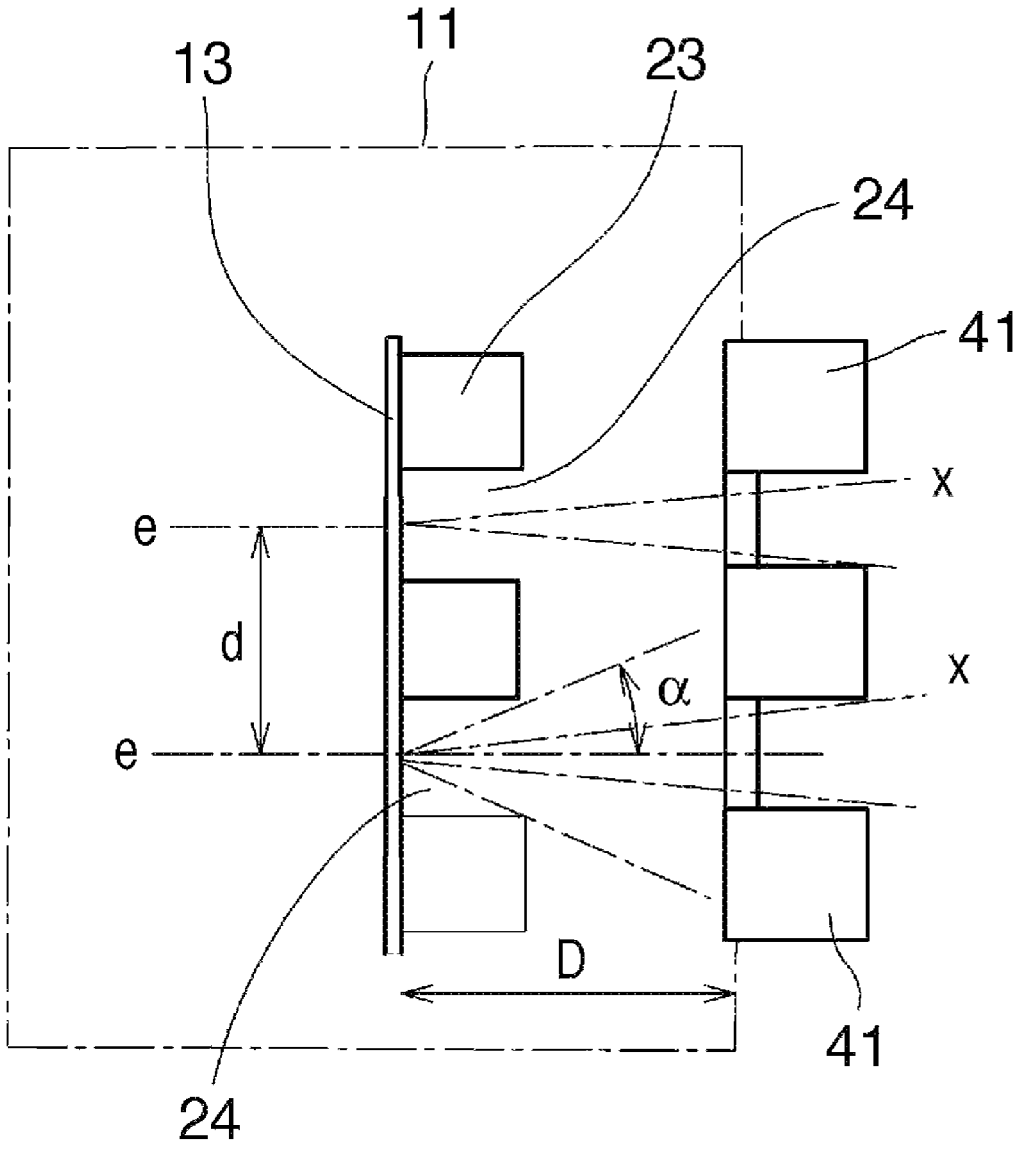
FIG. 9 is a view showing the arrangement of the multi transmission-type target portion having the X-ray shielding plate.

Referring to FIG. 7, the divergence angles of the X-ray beams x are determined by the opening conditions of the X-ray extraction portions 24 arranged in the vacuum chamber 11. In some cases, it is required to adjust the divergence angles of the X-ray beams x depending on imaging conditions. Referring to FIG. 9, in order to meet this requirement, this apparatus includes two shielding means. That is, in addition to the X-ray shielding plate 23 in the vacuum chamber, an X-ray shielding plate 41 is provided outside the vacuum chamber 11. Since it is easy to replace the X-ray shielding plate 41 provided in the atmosphere, a divergence angle can be arbitrarily selected for the X-ray beam x in accordance with the irradiation conditions for an object.

The following condition is required to prevent X-ray beams from adjacent X-ray sources from leaking to the outside by providing the X-ray shielding plate 23 in the vacuum chamber 11 and the X-ray shielding plate 41 outside the vacuum chamber 11. That is, the X-ray shielding plates 23 and 41 and the X-ray extraction portions 24 need to be set to maintain the relationship of $d>2D\cdot\tan\alpha$ where d is the distance between the X-ray beams x, D is the distance between the transmission-type target portion 13 and the X-ray shielding plate 41, and $\alpha$ is the radiation angle of the X-ray beam x exiting the X-ray shielding plate 23.

When the high-energy electron beam e strikes the transmission-type target portion 13, not only reflected electrons but also X-rays are scattered in the reflecting direction. These X-rays and electron beams are regarded as the causes of leakage X-rays from the X-ray sources and fine discharge with a high voltage.

Figure 10:
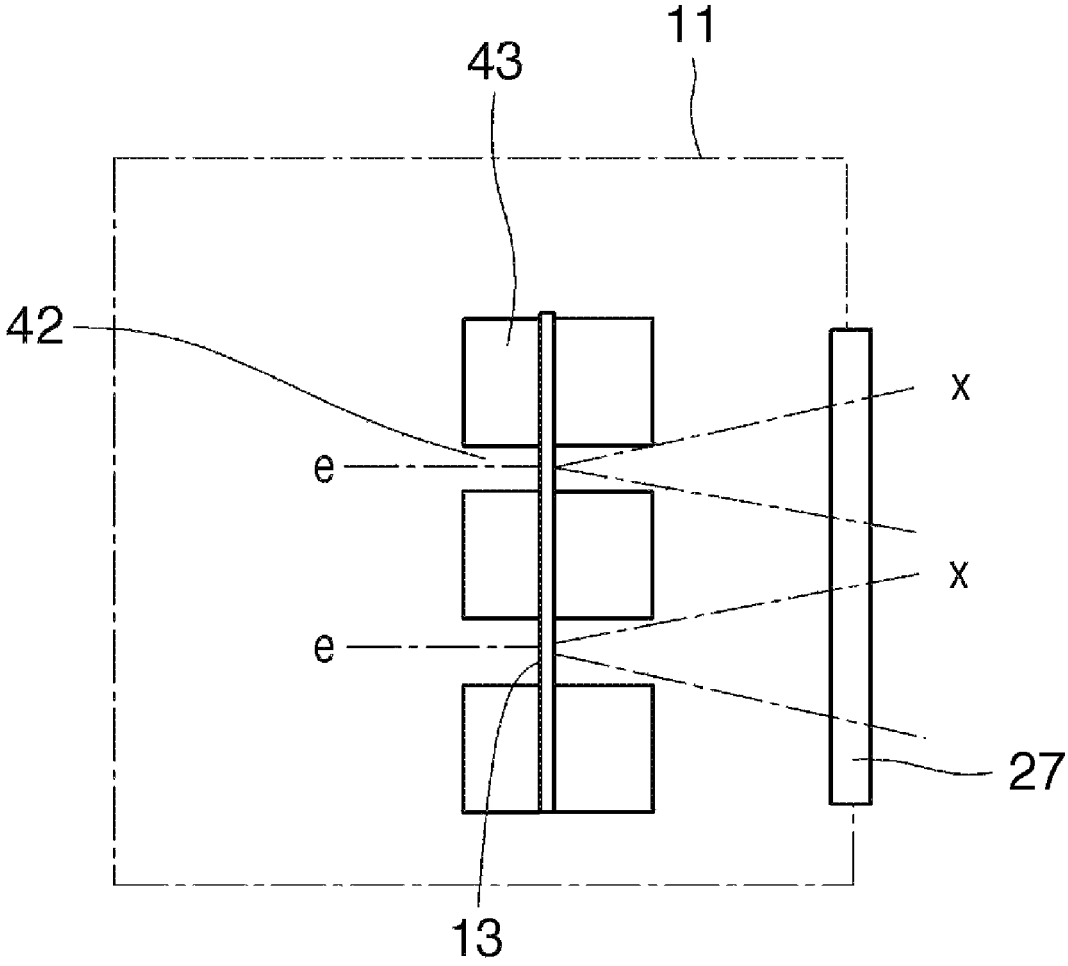
FIG. 10 is a view showing the arrangement of a transmission-type target portion having an X-ray/reflected electron beam shielding plate.

FIG. 10 shows a countermeasure against this problem. An X-ray/reflected electron beam shielding plate 43 having electron beam incident holes 42 is provided on the electron emission element 15 side of the transmission-type target portion 13. The electron beams e emitted from the electron emission elements 15 pass through the electron beam incident holes 42 of the X-ray/reflected electron beam shielding plate 43 and strike the transmission-type target portion 13. With this structure, the X-ray/reflected electron beam shielding plate 43 can block X-rays, reflected electrons, and secondary electrons generated on the electron source side from the surface of the transmission-type target portion 13.

When X-ray beams x are to be formed by irradiating the transmission-type target portion 13 with the high-energy electron beams e, the density of the X-ray beams x is not limited by the packing density of the electron emission elements 15. This density is determined by the X-ray shielding plates 23 and 41 for extracting the separate X-ray beams x from multi X-ray sources generated by the transmission-type target portion 13.

Table 1 shows the shielding effects of heavy metals (Ta, W, and Pb) against X-ray beams with energies of 50 keV, 62 keV, and 82 keV, assuming the energies of the X-ray beams x generated when the transmission-type target portion 13 is irradiated with the 100-key electron beams e.

TABLE 1

Thickness of Shielding Material
(unit: cm, attenuation factor: 1/100)

| Shielding Material | 82 keV | 62 keV | 50 keV |
|---|---|---|---|
| Ta | 0.86 | 1.79 | 0.99 |
| W | 0.72 | 1.48 | 0.83 |
| Pb | 1.98 | 1.00 | 0.051 |

As a shielding criterion among the X-ray beams x generated from the transmission-type target portion 13, an attenuation factor of 1/100 is a proper value as an amount which does not influence X-ray images. Obviously, a heavy metal plate having a thickness of about 5 to 10 mm is required as a shielding plate for achieving this attenuation factor.

Figure 11:
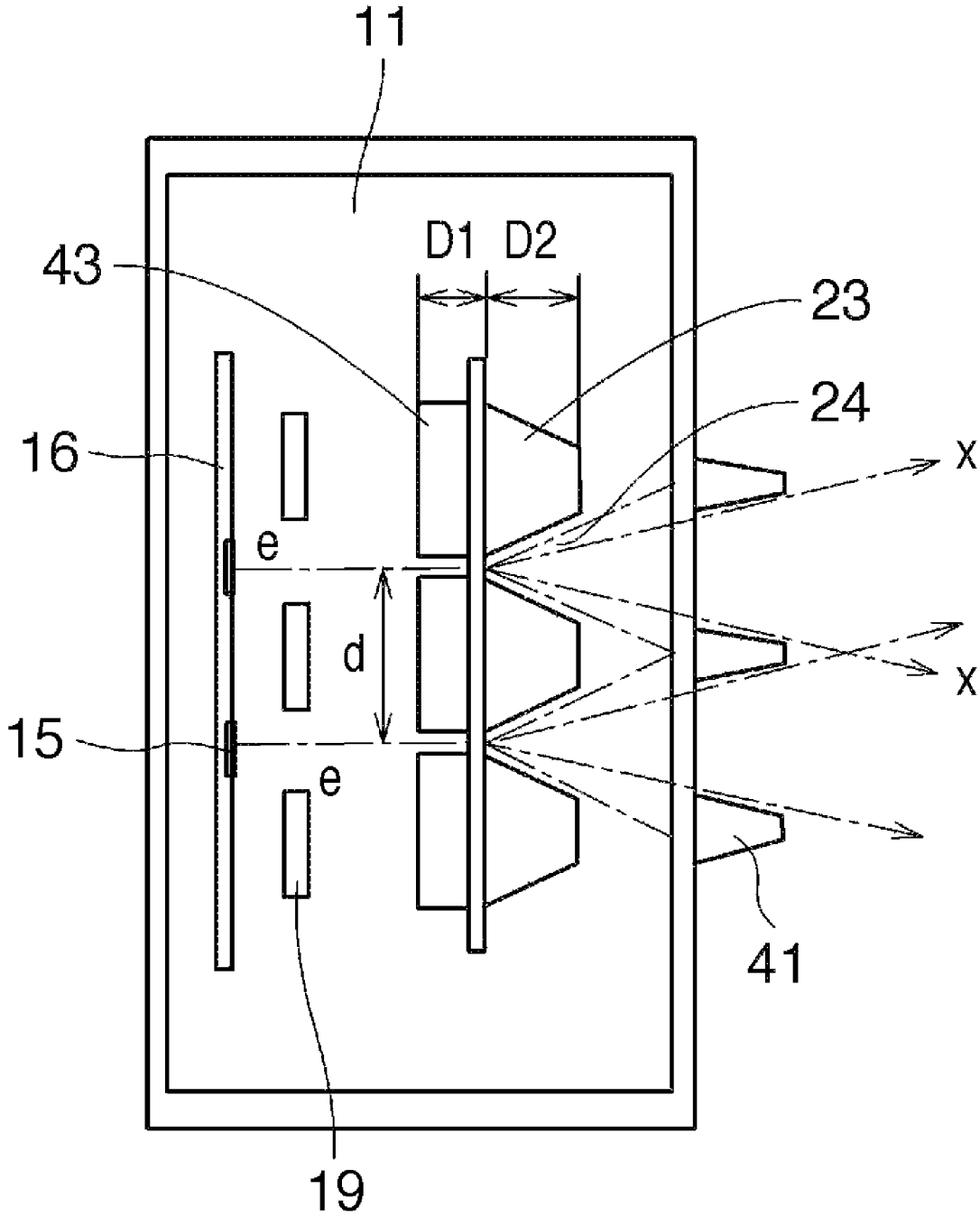
FIG. 11 is a view showing the arrangement of an X-ray shielding plate provided with a tapered X-ray extraction portion.

When this scheme is to be applied to a multi X-ray source body using the electron beams e of about 100 keV, it is appropriate to set thicknesses D1 and D2 of the X-ray/reflected electron beam shielding plate 43 and X-ray shielding plate 23 shown in FIG. 11 to 5 to 10 mm. In addition, forming the X-ray extraction portions 24 of the X-ray shielding plate 23 in a vacuum into tapered windows makes it possible to improve the shielding effect.

Second Embodiment

Figure 12:
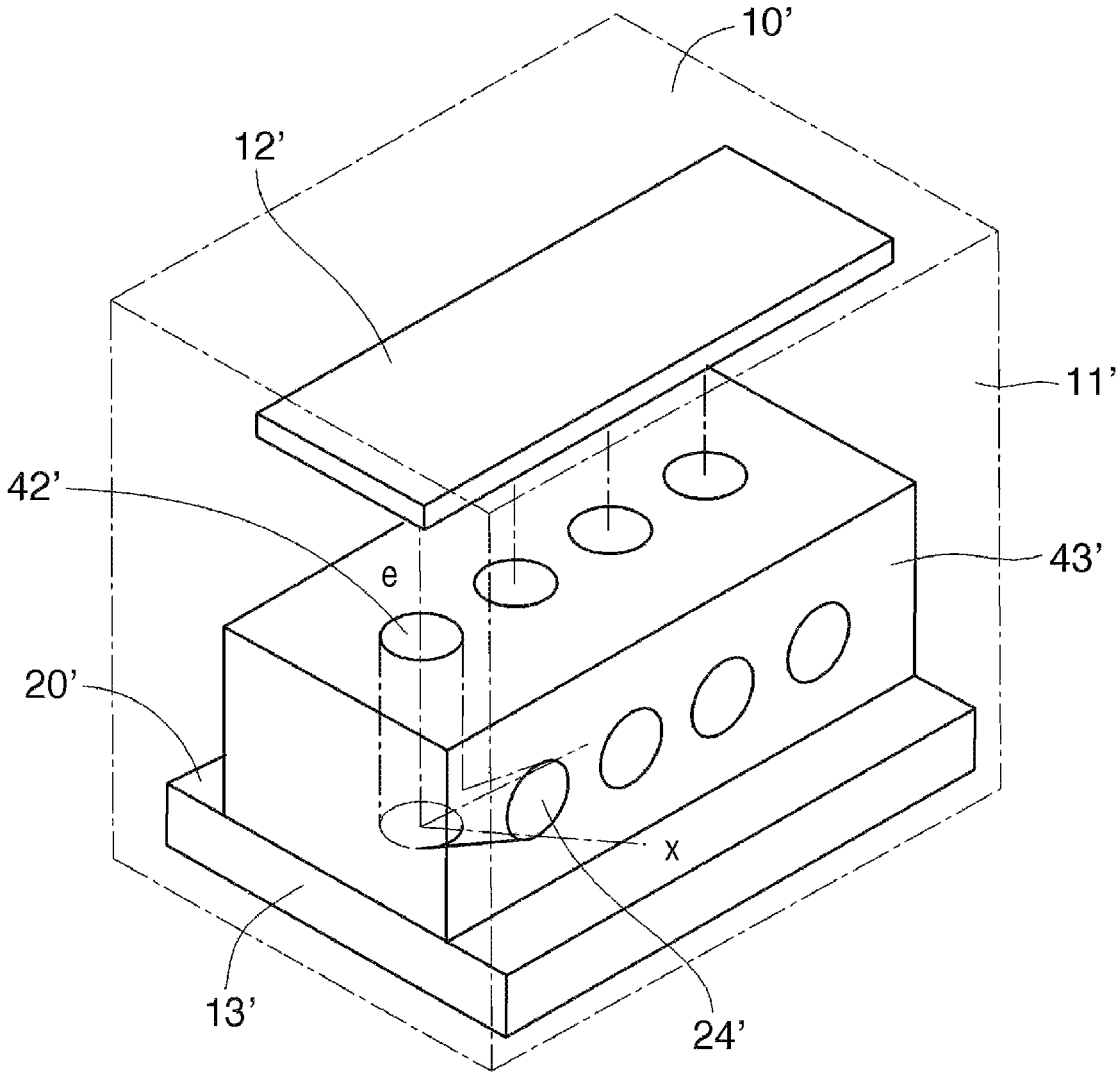
FIG. 12 is a perspective view of a multi X-ray source body comprising a reflection-type target portion according to the second embodiment.

FIG. 12 is a view showing the arrangement of the second embodiment, which is the structure of a multi X-ray source body 10' comprising a reflection-type target portion 13'. This structure comprises an electron beam generating unit 12' and an anode electrode 20' comprising the reflection-type target portion 13' and an X-ray/reflected electron beam shielding plate 43' including electron beam incident holes 42' and X-ray extraction portions 24' in a vacuum chamber 11'.

In the electron beam generating unit 12', electron beams e emitted from the electron emission elements 15 pass through a lens electrode and accelerated to high energy. The accelerated electron beams e pass through the electron beam incident holes 42' of the X-ray/reflected electron beam shielding plate 43' and are applied to the reflection-type target portion 13'. The X-rays generated by the reflection-type target portion 13' are extracted as X-ray beams x from the X-ray extraction portions 24' of the X-ray/reflected electron beam shielding plate 43'. A plurality of X-ray beams x form multi X-ray beams. The X-ray/reflected electron beam shielding plate 43' can greatly suppress the scattering of reflected electrons which cause high-voltage discharge.

As in the arrangement shown in FIG. 9 in which the radiation angles of the X-ray beams x are adjusted by using the X-ray shielding plate 23 in the vacuum chamber 11 and the X-ray shielding plate 41 outside the vacuum chamber 11, in the arrangement shown in FIG. 12, the radiation angles of the X-ray beams x can be adjusted by using the X-ray shielding plate 41 outside the vacuum chamber 11.

Figure 15:
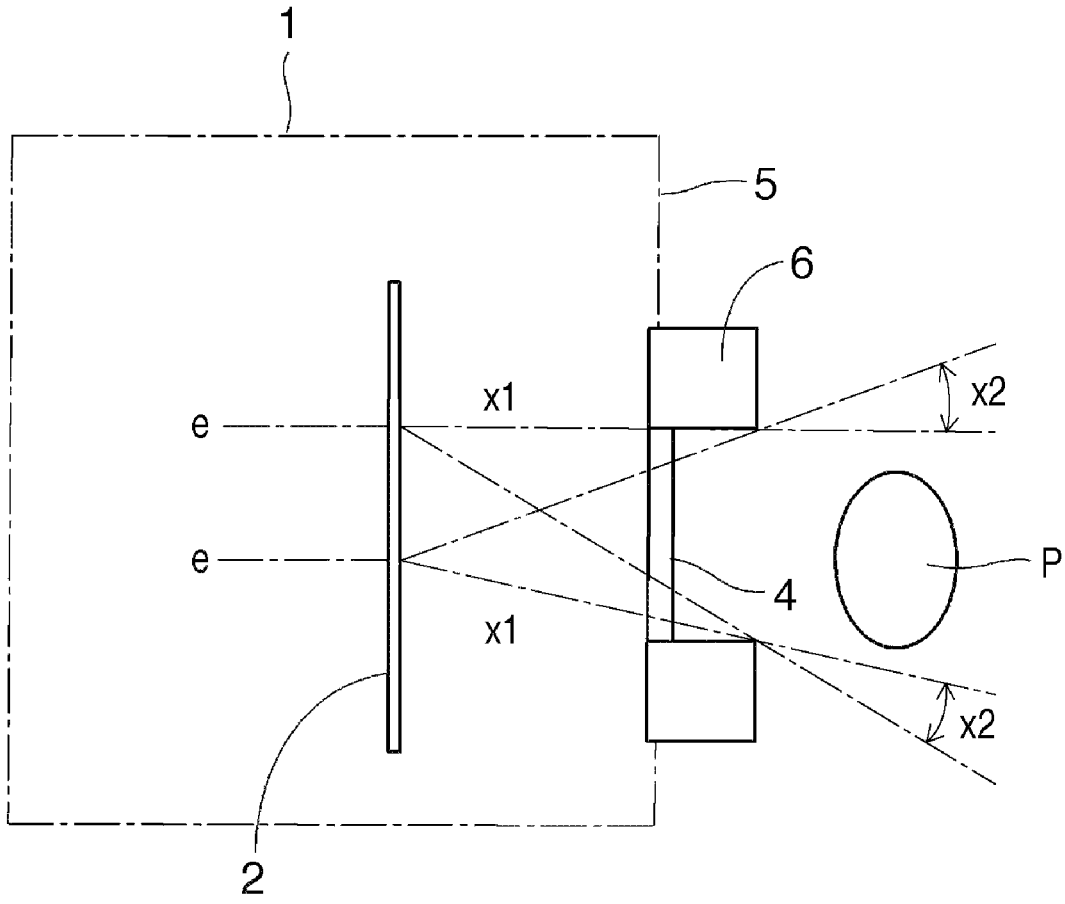
FIG. 15 is a view showing a conventional multi X-ray source.

The second embodiment has exemplified an application of the present invention to the reflection-type target portion 13' with a planar structure. However, the present invention can also be applied to a multi X-ray source body in which the electron beam generating unit 12', the anode electrode 20', and the reflection-type target portion 13' are arranged in an arcuated shape. For example, placing the reflection-type target portion 13' in an arcuated shape centered on an object and providing the X-ray shielding plates 23 and 41 can extremely reduce the region of the leakage X-rays x2 in the prior art shown in FIG. 15. Note that this arrangement can also be applied to the transmission-type target portion 13 in the same manner.

As described above, the second embodiment can extract the independent X-ray beam x which has a high S/N ratio with very few scattered X-rays or leakage X-rays, from the X-rays generated by irradiating the reflection-type target portion 13' with the electron beams e. Using this X-ray beam x can therefore execute X-ray imaging with high contrast and high image quality.

Third Embodiment

Figure 13:
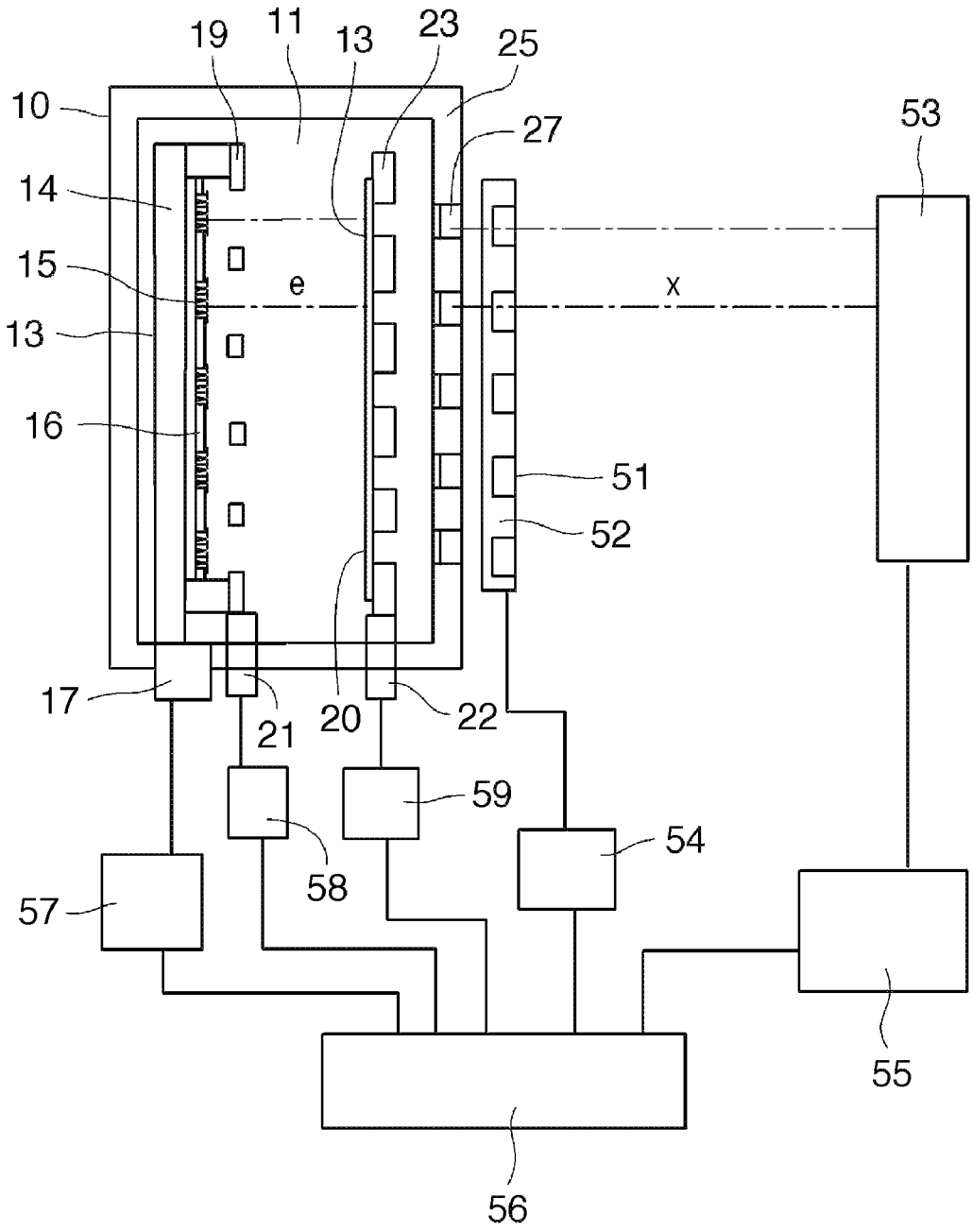
FIG. 13 is a view showing the arrangement of a multi X-ray imaging apparatus according to the third embodiment.
Figure 14:
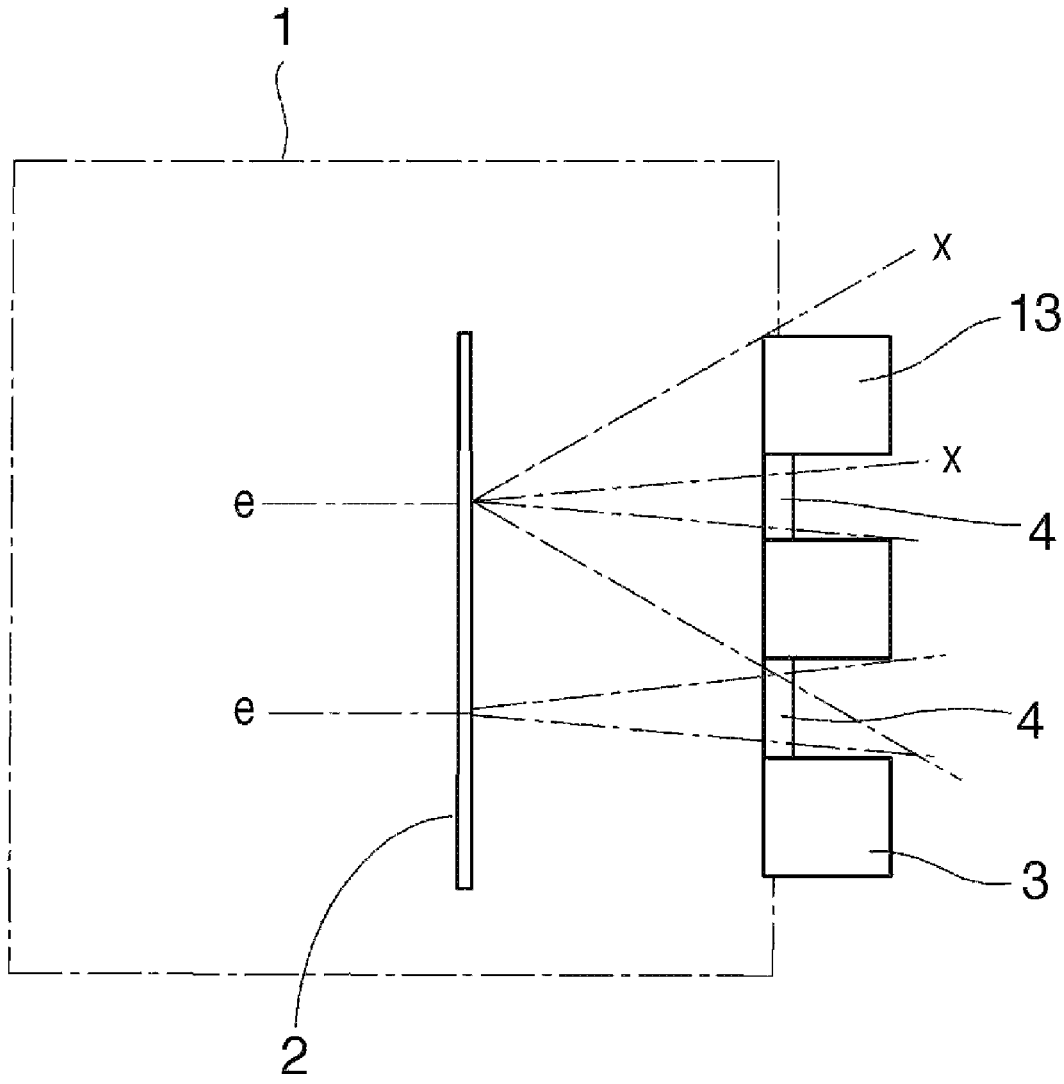
FIG. 14 is a view showing the arrangement of a conventional multi X-ray source.

FIG. 13 is a view showing the arrangement of a multi X-ray imaging apparatus. This imaging apparatus has a multi X-ray intensity measuring unit 52 including a transmission type X-ray detector 51 which is placed in front of the multi X-ray source body 10 shown in FIG. 1. This apparatus further has an X-ray detector 53 placed through an object (not shown). The multi X-ray intensity measuring unit 52 and the X-ray detector 53 are connected to a control unit 56 via X-ray detection signal processing units 54 and 55, respectively. In addition, the output of the control unit 56 is connected to a driving signal unit 17 via an electron emission element driving circuit 57. Outputs of the control unit 56 are respectively connected to high voltage introduction portions 21 and 22 of a lens electrode 19 and anode electrode 20 via high voltage control units 58 and 59.

As in the first embodiment, the multi X-ray source body 10 generates a plurality of X-ray beams x by irradiating a transmission-type target portion 13 with a plurality of electron beams e extracted from an electron beam generating unit 12. The plurality of generated X-ray beams x are extracted as multi X-ray beams toward the multi X-ray intensity measuring unit 52 in the atmosphere via X-ray extraction windows 27 provided in a wall portion 25. The multi X-ray beams (the plurality of X-ray beams x) are impinged upon an object after being transmitted through the transmission type X-ray detector 51 of the multi X-ray intensity measuring unit 52. The multi X-ray beams transmitted through the object are detected by the X-ray detector 53, thus obtaining an X-ray transmission image of the object.

In electron emission elements 15 arrayed on an element array 16, slight variations occur in the current-voltage characteristics between the electron emission elements 15. The variations in emission current lead to variations in the intensity distribution of multi X-ray beams, resulting in contrast irregularity at the time of X-ray imaging. It is therefore necessary to uniform emission currents in the electron emission elements 15.

The transmission type X-ray detector 51 of the multi X-ray intensity measuring unit 52 is a detector using a semiconductor. The transmission type X-ray detector 51 absorbs parts of multi X-ray beams and converts them into electrical signals. The switch control circuit 54 then converts the obtained electrical signals into digital data. The control unit 56 stores the digital data as the intensity data of the plurality of X-ray beams x.

The control unit 56 stores correction data for the electron emission elements 15 which correspond to the voltage-current characteristics of the electron emission elements 15 in FIG. 6, and determines the set values of correction voltages for the electron emission elements 15 by comparing the correction data with the detection intensity data of multi X-ray beams. Driving voltages for driving signals S1 and S2 obtained by the driving signal unit 17 controlled by the electron emission element driving circuit 57 are corrected by using these correction voltages. This makes it possible to uniform emission currents in the electron emission elements 15 and uniform the intensities of the X-ray beams x in the multi X-ray beams.

The X-ray intensity correction method using the transmission type X-ray detector 51 can measure an X-ray intensity regardless of an object, and hence can correct the intensities of the X-ray beams x in real time during X-ray imaging.

Independently of the above correction method, it is also possible to correct the intensities of multi X-ray beams by using the X-ray detector 53 for imaging. The X-ray detector 53 uses a two-dimensional type X-ray detector such as a CCD solid-state imaging or an imaging using amorphous silicon, and can measure the intensity distributions of the respective X-ray beams.

In order to correct the intensities of the X-ray beams x by using the X-ray detector 53, it suffices to extract the electron beam e by driving the single electron emission element 15 and synchronously detect the intensity of the generated X-ray beam x by using the X-ray detector 53. In this case, it is possible to efficiently measure the intensity distributions of multi X-ray beams by performing measurement upon synchronizing a generation signal for each X-ray beam of multi X-ray beams with a detection signal from the X-ray detector 53 for imaging. This detection signal is converted into a digital signal by the X-ray detection signal processing unit 55. The signal is then stored in the control unit 56.

This operation is performed for all the electron emission elements 15. The resultant data are then stored as the intensity distribution data of all multi X-ray beams in the control unit 56. At the same time, correction values for driving voltages for the electron emission elements 15 are determined by using part or the integral value of the intensity distributions of multi X-ray beams.

At the time of X-ray imaging of the object, the multi electron emission element driving circuit 57 drives the electron emission elements 15 in accordance with the correction values for driving voltages. Performing this series of operations as periodic apparatus calibration can uniform the intensities of the X-ray beams x.

The above description has exemplified the case in which the electron emission elements 15 are individually driven to measure X-ray intensities. However, it is possible to speed up measurement by simultaneously irradiating with X-ray beams x a plurality of portions on the X-ray detector 53 on which the applied X-ray beams x do not overlap.

In addition, this correction method has the intensity distribution of each X-ray beam x as data, and hence can be used to correct irregularity in the X-ray beams x.

The X-ray imaging apparatus using the multi X-ray source body 10 of this embodiment can implement a planar X-ray source with an object size by arranging the X-ray beams x in the above manner, and hence the apparatus size can be reduced by placing the multi X-ray source body 10 near the X-ray detector 53. In addition, as described above, for the X-ray beams x, X-ray irradiation intensities and irradiation regions can be arbitrarily selected by designating driving conditions for the electron emission element driving circuit 57 and element regions to be driven.

In addition, the multi X-ray imaging apparatus can select the radiation angles of the X-ray beams x by changing the X-ray shielding plate 41 provided outside the vacuum chamber 11 shown in FIG. 9. Therefore, the optimal X-ray beam x can be obtained in accordance with imaging conditions such as the distance between the multi X-ray source body 10 and an object and a resolution.

The present invention is not limited to the above embodiments and various changes and modifications can be made within the spirit and scope of the present invention. Therefore, to apprise the public of the scope of the present invention the following claims are made.

This application claims priority from Japanese Patent Application No. 2006-057846 filed on Mar. 3, 2006, and Japanese Patent Application No. 2007-050942 filed on Mar. 1, 2007, the entire contents of which are hereby incorporated by reference herein.

The invention claimed is:

1. A multi-X-ray generator comprising:

a chamber;

a plurality of electron emission elements provided inside said chamber;

an acceleration unit provided inside said chamber, and configured to accelerate electron beams emitted from said plurality of electron emission elements; and a target portion which is irradiated with the electron beams, wherein said target portion is provided inside said chamber and in correspondence with the electron beams;

a first X-ray shielding unit provided on an X-ray ejection side of said target portion; and a second X-ray shielding unit which is provided outside said chamber and is configured to be replaced in an atmosphere; and a third X-ray shielding unit provided inside said chamber and provided on an electron beam irradiation side of said target portion, wherein X-rays generated from said target portion are extracted as multi-X-ray beams into the atmosphere through the first and second X-ray shielding units, and wherein said third shielding unit is configured to suppress scattered X-rays and reflected electron beams, and comprises an incident hole for an electron beam.

2. The multi-X-ray generator according to claim 1, wherein said electron emission elements comprise cold-cathode electron sources, and wherein voltage control is performed on said electron emission elements on the basis of an irradiation condition of X-ray beams to allow ON/OFF control on each X-ray beam of the multi-X-ray X-ray beams.

3. The multi-X-ray generator according to claim 1, wherein said first X-ray shielding unit is constructed to dissipate heat generated in said target portion.

4. The multi-X-ray generator according to claim 1, wherein said target portion and said first and second X-ray shielding units are arranged in an arcuate shape centered on a position where an object is to be placed.

5. The multi-X-ray generator according to claim 1, wherein said target portion comprises a transmission-type target portion.

6. The multi-X-ray generator according to claim 5, wherein said transmission-type target portion comprises an X-ray generating layer comprising a heavy metal and an X-ray generation support layer comprising a light element with a good X-ray transmission characteristic.

7. The multi-X-ray generator according to claim 6, wherein said X-ray generation support layer includes a filter function of changing a radiation quality of the X-rays generated from the X-ray generating layer, and comprises a material with high thermal conductivity.

8. The multi-X-ray generator according to claim 6, wherein said X-ray generation support layer uses a substrate comprising one of Al, AlN, and SiC or a combination thereof.

9. The multi-X-ray generator according to claim 1, wherein said target portion comprises a reflection-type target portion.

10. The multi-X-ray generator according to claim 1, wherein intensities of the multi-X-ray beams are controlled by driving voltages for said plurality of electron emission elements on the basis of correction data.

11. The multi-X-ray generator according to claim 10, wherein the correction data is obtained by measurement using a transmission-type multi-X-ray intensity measuring unit corresponding to the multi-X-ray beams.

12. The multi-X-ray generator according to claim 10, wherein the correction data is obtained by measurement upon synchronizing a generation signal for each of the multi-X-ray beams with a detection signal from an X-ray detector for imaging.

13. A multi-X-ray imaging apparatus comprising a multi-X-ray generator, said multi-X-ray generator comprising a chamber, a plurality of electron emission elements provided inside said chamber, an acceleration unit provided inside said chamber, and configured to accelerate electron beams emitted from said plurality of electron emission elements, a target portion which is irradiated with the electron beams, wherein said target portion is provided inside said chamber and in correspondence with the electron beams, a first X-ray shielding unit provided on an X-ray ejection side of said target portion, a second X-ray shielding unit which is provided outside said chamber and is configured to be replaced in an atmosphere, and a third X-ray shielding unit provided inside said chamber and provided on an electron beam irradiation side of said target portion, wherein X-rays generated from said target portion are extracted as multi-X-ray beams into the atmosphere through the first and second X-ray shielding units, and wherein said third shielding unit is configured to suppress scattered X-rays and reflected electron beams, and comprises an incident hole for an electron beam, and said apparatus detecting, imaging, and diagnosing an X-ray transmission image of the X-ray beams obtained by irradiating an object with the multi-X-ray beams.

* * * * *